US011156372B2

(12) United States Patent
Komatsu et al.

(10) Patent No.: US 11,156,372 B2
(45) Date of Patent: Oct. 26, 2021

(54) INDOOR UNIT FOR CEILING-CONCEALED AIR-CONDITIONING APPARATUS, AND CEILING-CONCEALED AIR-CONDITIONING APPARATUS INCLUDING THE SAME

(71) Applicant: Mitsubishi Electric Corporation, Tokyo (JP)

(72) Inventors: Takahiro Komatsu, Tokyo (JP); Tetsuya Tazawa, Tokyo (JP); Keisuke Tomomura, Tokyo (JP); Hironobu Suehiro, Tokyo (JP); Takaaki Takishita, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 145 days.

(21) Appl. No.: 16/345,477

(22) PCT Filed: Jan. 30, 2017

(86) PCT No.: PCT/JP2017/003129
§ 371 (c)(1),
(2) Date: Apr. 26, 2019

(87) PCT Pub. No.: WO2018/138899
PCT Pub. Date: Aug. 2, 2018

(65) Prior Publication Data

US 2019/0346157 A1 Nov. 14, 2019

(51) Int. Cl.
*F24F 13/20* (2006.01)
*F24F 1/0047* (2019.01)
(Continued)

(52) U.S. Cl.
CPC ..... *F24F 1/0047* (2019.02); *F24F 1/0011* (2013.01); *F24F 13/20* (2013.01); *F24F 13/32* (2013.01)

(58) Field of Classification Search
CPC ..... F24F 1/0047; F24F 1/0011; F24F 13/20; F24F 13/32
See application file for complete search history.

(56) References Cited

U.S. PATENT DOCUMENTS 4,495,672 A * 1/1985 Adams ..... E05D 7/1011 16/229
7,090,264 B2 8/2006 Dzurko et al.
(Continued)

FOREIGN PATENT DOCUMENTS

EP 2 295 878 A2 3/2011
JP H07-260194 A 10/1995
(Continued)

OTHER PUBLICATIONS

Tomomura, JP 2012-163255 A English machine translation, Aug. 30, 2012 (Year: 2012).*
(Continued)

*Primary Examiner* — Edelmira Bosques
*Assistant Examiner* — Phillip Decker
(74) *Attorney, Agent, or Firm* — Posz Law Group, PLC

(57) ABSTRACT

An indoor unit for a ceiling-concealed air-conditioning apparatus includes an indoor-unit body having an air inlet at a bottom, a decorative panel provided at the bottom of the indoor-unit body and serving as a design surface, and an inlet grille flap rotatably supported by the decorative panel and covering the air inlet. The inlet grille flap is provided with rotational-axis hinges positioned on both sides at one edge of the inlet grille flap and serving as a rotational axis of the inlet grille flap, and a latch part positioned between the two rotational-axis hinges and projecting from the one edge. The decorative panel has a flange positioned below the latch part and supporting the latch part from below when the inlet grille flap is closed.

7 Claims, 6 Drawing Sheets

(51) Int. Cl.
*F24F 1/0011* (2019.01)
*F24F 13/32* (2006.01)

(56) References Cited

U.S. PATENT DOCUMENTS

| | | | | |
|---|---|---|---|---|
| 2008/0188175 | A1 | 8/2008 | Wilkins | |
| 2015/0323218 | A1* | 11/2015 | Terano | F25B 39/00 165/121 |

FOREIGN PATENT DOCUMENTS

| | | | | |
|---|---|---|---|---|
| JP | H09-196407 | A | | 7/1997 |
| JP | H11-063553 | A | | 3/1999 |
| JP | H11-351606 | A | | 12/1999 |
| JP | 2011-027336 | A | | 2/2011 |
| JP | 2012163255 | A | * | 8/2012 |
| JP | 2015-137842 | A | | 7/2015 |

OTHER PUBLICATIONS

Office Action dated Mar. 31, 2020 issued in corresponding JP patent application No. 2018-564063 (and English translation).
International Search Report of the International Searching Authority dated Apr. 4, 2017 for the corresponding international application No. PCT/JP2017/003129 (and English translation).
Examination Report dated Apr. 25, 2021, issued in corresponding IN Patent Application No. 201947027769 (and English Machine Translation).

* cited by examiner

INDOOR UNIT FOR CEILING-CONCEALED AIR-CONDITIONING APPARATUS, AND CEILING-CONCEALED AIR-CONDITIONING APPARATUS INCLUDING THE SAME

CROSS REFERENCE TO RELATED APPLICATION

This application is a U.S. national stage application of PCT/JP2017/003129 filed on Jan. 30, 2017, the contents of which are incorporated herein by reference.

TECHNICAL FIELD

The present invention relates to an indoor unit for a ceiling-concealed air-conditioning apparatus having a structure for suppressing deformation of an inlet grille flap that may occur due to the weight of the inlet grille flap itself and a ceiling-concealed air-conditioning apparatus including the indoor unit inlet grille flap due to the weight of inlet grille flap.

BACKGROUND ART

A hitherto proposed ceiling-concealed air-conditioning apparatus includes a hinge connecting a decorative panel and an inlet grille flap to each other and supporting the inlet grille flap such that the inlet grille flap is rotatable relative to the decorative panel, and a securing hinge suppressing deformation of the inlet grille flap that may occur due to the weight of the inlet grille flap itself (see Patent Literature 1, for example).

The securing hinge according to Patent Literature 1 includes a first hinge member fixed to the decorative panel, and a second hinge member fixed to the inlet grille flap. The first hinge member is provided with an arm fixed thereto. The arm is provided with a support pin fixed to the tip thereof. The second hinge member has a support hole with an open top. When the inlet grille flap is closed, the support pin fits into the support hole. When the inlet grille flap is opened, the support pin comes off the support hole.

CITATION LIST

Patent Literature

Patent Literature 1: Japanese Unexamined Patent Application Publication No. 9-196407

SUMMARY OF INVENTION

Technical Problem

According to Patent Literature 1, when the inlet grille flap is attached to the decorative panel, both the hinge and the securing hinge need to be positioned, leading to a problem of difficulty in attaching the inlet grille flap to the decorative panel.

The present invention is to overcome the above problem and provides an indoor unit for a ceiling-concealed air-conditioning apparatus and a ceiling-concealed air-conditioning apparatus including the same, in which deformation of an inlet grille flap due to the weight of the inlet grille flap itself can be suppressed, and the ease of attaching the inlet grille flap to a decorative panel can be increased.

Solution to Problem

An indoor unit for a ceiling-concealed air-conditioning apparatus according to an embodiment of the present invention includes an indoor-unit body having an air inlet at a bottom; a decorative panel provided at the bottom of the indoor-unit body and serving as a design surface; and an inlet grille flap rotatably supported by the decorative panel and covering the air inlet, the inlet grille flap being provided with a rotational-axis hinge positioned on each of both sides at one edge of the inlet grille flap and serving as a rotational axis of the inlet grille flap, and a latch part positioned between the two rotational-axis hinges and projecting from the one edge, the decorative panel having a flange positioned below the latch part and supporting the latch part from below when the inlet grille flap is closed.

Advantageous Effects of Invention

In the indoor unit for a ceiling-concealed air-conditioning apparatus according to the embodiment of the present invention, the inlet grille flap is provided with the latch part positioned between the two rotational-axis hinges and projecting from the one edge, and the decorative panel has the flange positioned below the latch part and supporting the latch part from below when the inlet grille flap is closed. Since the flange supports the latch part from below, deformation of the inlet grille flap due to the weight of the inlet grille flap itself can be suppressed. Furthermore, since the flange supports the latch part from below when the inlet grille flap is closed, the inlet grille flap can be attached to the decorative panel only by positioning the rotational-axis hinges. Thus, the ease of attaching the inlet grille flap to the decorative panel can be increased.

DESCRIPTION OF EMBODIMENTS

Figure 1:
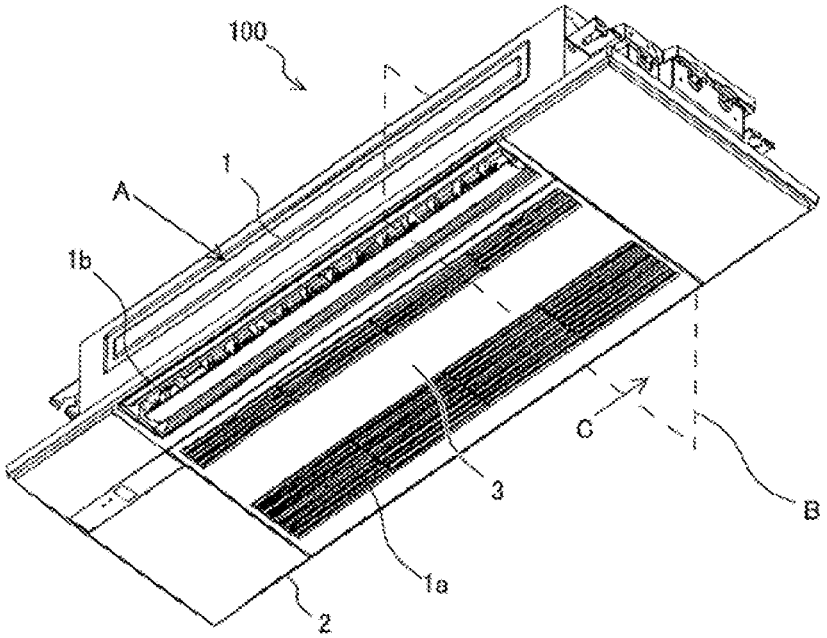
FIG. 1 is a front perspective view of an indoor unit for a ceiling-concealed air-conditioning apparatus according to Embodiment 1 of the present invention, with an inlet grille flap closed.

Embodiments of the present invention will now be described with reference to the drawings. Note that the following embodiments do not limit the present invention, and elements illustrated in the drawings are not necessarily to scale in relation to each other.

Embodiment 1

FIG. 1 is a front perspective view of an indoor unit 100 for a ceiling-concealed air-conditioning apparatus according to Embodiment 1 of the present invention, with an inlet grille flap 3 closed.

In Embodiment 1, for easy understanding, terms representing directions (such as "top", "bottom", "right", "left", "front", "rear", and so forth) are used as necessary. Such terms are only for explanation and do not limit the present invention. In Embodiment 1, as illustrated in FIG. 1, the terms representing directions are used on the premise that the indoor unit 100 for a ceiling-concealed air-conditioning apparatus is seen from the front side in a direction represented by arrow A.

The indoor unit 100 for a ceiling-concealed air-conditioning apparatus according to Embodiment 1 is installed in such a manner as to be embedded in the ceiling and includes, as illustrated in FIG. 1, a box-shaped indoor-unit body 1 embedded in the ceiling, a flat plate-shaped decorative panel 2 provided at the bottom of the indoor-unit body 1 and serving as a design surface, and the flat plate-shaped inlet grille flap 3 rotatably attached to the decorative panel 2.

The indoor-unit body 1 has an air inlet 1*a* and an air outlet 1*b* at the bottom thereof. When the inlet grille flap 3 is closed, the air inlet 1*a* is covered by the inlet grille flap 3. The indoor-unit body 1 has thereinside an indoor heat exchanger (not illustrated) and an indoor fan (not illustrated).

Here, the flow of air generated in the indoor unit 100 for a ceiling-concealed air-conditioning apparatus according to Embodiment 1 will be described briefly.

When indoor air taken in from the air inlet 1*a* flows through the indoor heat exchanger, heat is exchanged between the indoor air and refrigerant flowing in the indoor heat exchanger. The indoor air is cooled in a cooling operation or is heated in a heating operation, and reaches the indoor fan. The air thus conditioned flows through an air duct and is blown from the air outlet 1*b* to an indoor space.

Figure 2:
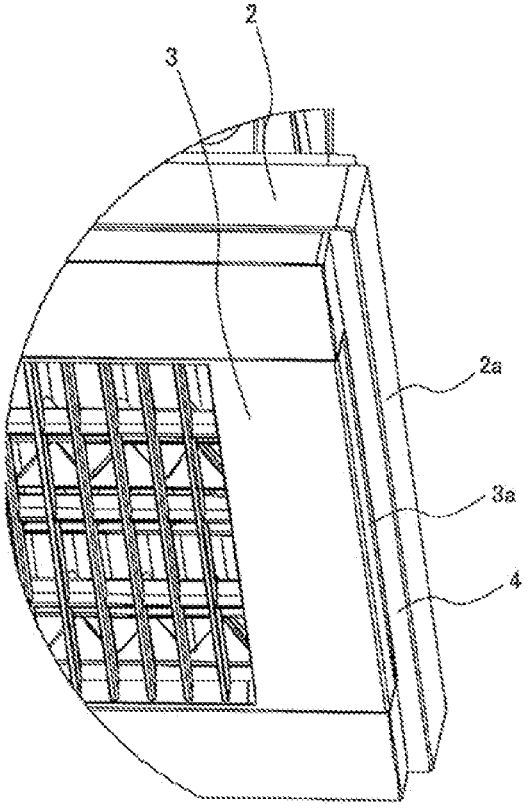
FIG. 2 is an enlargement of an area around a joint between a decorative panel and the inlet grille flap on the rear side of the indoor unit for a ceiling-concealed air-conditioning apparatus illustrated in FIG. 1.

FIG. 2 is an enlargement of an area around a joint between the decorative panel 2 and the inlet grille flap 3 on the rear side of the indoor unit 100 for a ceiling-concealed air-conditioning apparatus illustrated in FIG. 1.

As illustrated in FIG. 2, on the rear side of the indoor unit 100, a rear side face 3*a* of the inlet grille flap 3 is positioned on the front side relative to a rear side face 2*a* of the decorative panel 2. Hence, when the inlet grille flap 3 is closed, a step 4 is formed at the joint between the decorative panel 2 and the inlet grille flap 3. Furthermore, the inlet grille flap 3 projects to the indoor side, corresponding to the lower side, relative to the decorative panel 2. Therefore, the indoor unit 100 for a ceiling-concealed air-conditioning apparatus according to Embodiment 1 can have an improved design.

Figure 3:
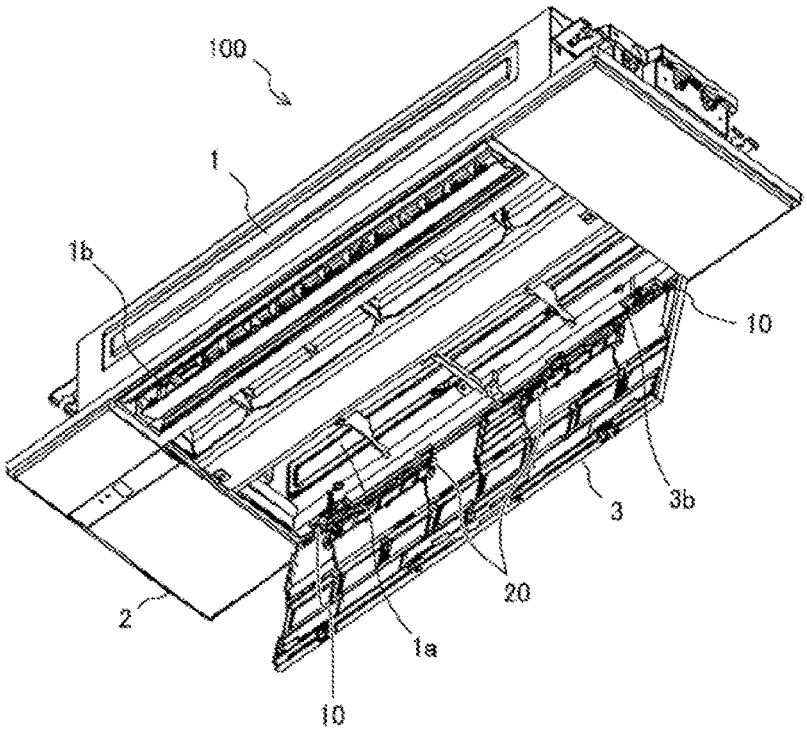
FIG. 3 is a front perspective view of the indoor unit for a ceiling-concealed air-conditioning apparatus according to Embodiment 1 of the present invention, with the inlet grille flap open.

FIG. 3 is a front perspective view of the indoor unit 100 for a ceiling-concealed air-conditioning apparatus according to Embodiment 1 of the present invention, with the inlet grille flap 3 open.

As illustrated in FIG. 3, the inlet grille flap 3 is provided with rotational-axis hinges 10 on the left and right sides, respectively, at one edge thereof, specifically, a rear end 3*b*. The rotational-axis hinges 10 serve as a rotational axis of the inlet grille flap 3. The rotational-axis hinges 10 are fitted in their associated bearings (not illustrated) provided on the decorative panel 2, whereby the inlet grille flap 3 is supported in such a manner as to be rotatable relative to the decorative panel 2. The inlet grille flap 3 has a securing structure (not illustrated), such as a latch or a screw, at a front end thereof opposite to the rear end having the rotational-axis hinges 10. When the inlet grille flap 3 is closed, the securing structure secures the inlet grille flap 3 to the decorative panel 2.

Securing hinges 20 are provided between the two rotational-axis hinges 10. The securing hinges 20 suppress deformation of the inlet grille flap 3 that may occur due to the weight of the inlet grille flap 3 itself when the inlet grille flap 3 is closed.

Figure 4:
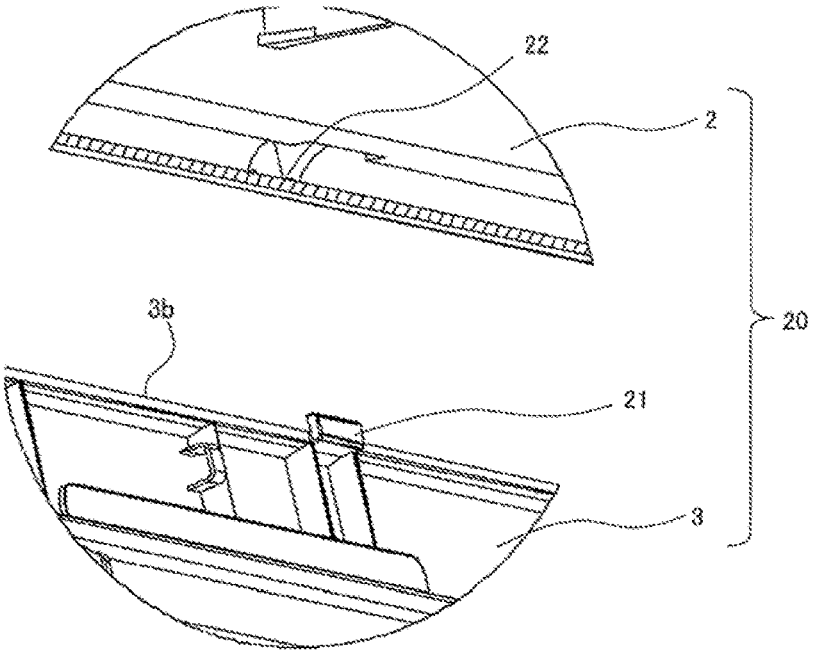
FIG. 4 is an enlargement of an area around a securing hinge of the indoor unit for a ceiling-concealed air-conditioning apparatus according to Embodiment 1 of the present invention.

FIG. 4 is an enlargement of an area around one of the securing hinges 20 of the indoor unit 100 for a ceiling-concealed air-conditioning apparatus according to Embodiment 1 of the present invention. In FIG. 4, the inlet grille flap 3 is detached from the decorative panel 2.

As illustrated in FIG. 4, the securing hinges 20 each include a latch part 21 projecting from the rear end 3*b* of the inlet grille flap 3, and a flange 22 provided on the decorative panel 2 at a position to face the latch part 21 in such a manner as to catch the latch part 21.

Figure 5:
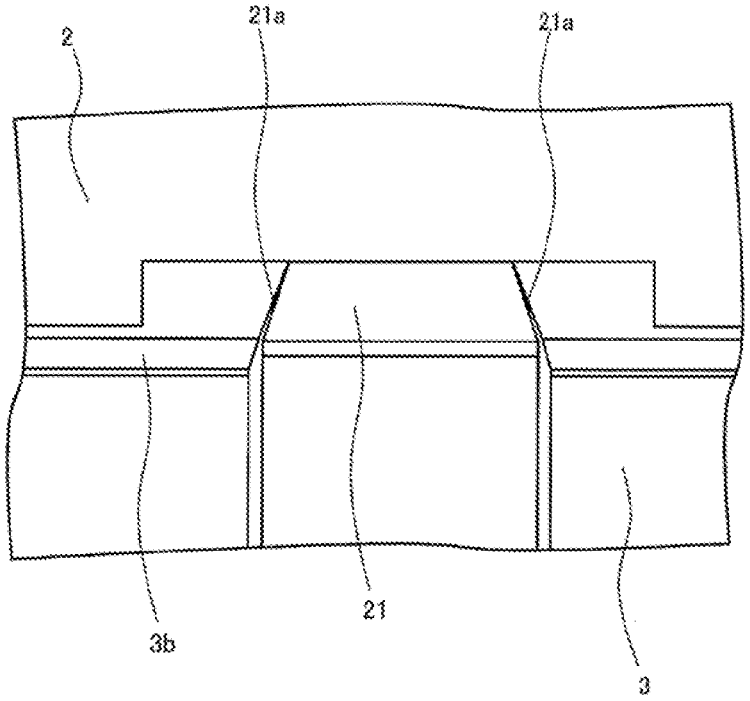
FIG. 5 is an enlargement of an area around a latch part seen from the front side, with the inlet grille flap of the indoor unit for a ceiling-concealed air-conditioning apparatus according to Embodiment 1 of the present invention open.

FIG. 5 is an enlargement of an area around the latch part 21 seen from the front side, with the inlet grille flap 3 of the indoor unit 100 for a ceiling-concealed air-conditioning apparatus according to Embodiment 1 of the present invention open.

As illustrated in FIG. 5, the latch part 21 has slopes at both of the left and right ends 21*a* thereof. Hence, the latch part 21 has a trapezoidal shape in front view.

Such a configuration suppresses interference between the latch part 21 and peripheral components that may occur when the inlet grille flap 3 is attached to the decorative panel 2. Thus, the ease of attaching the inlet grille flap 3 to the decorative panel 2 can be increased.

Figure 6:
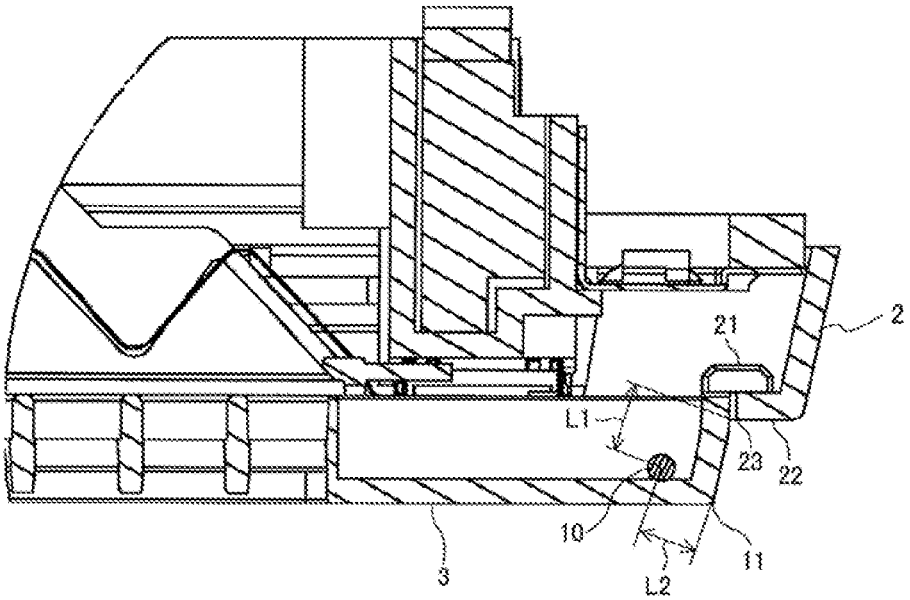
FIG. 6 illustrates a vertical cross-section of the indoor unit for a ceiling-concealed air-conditioning apparatus illustrated in FIG. 1, taken along plane B and seen in a direction represented by arrow C.
Figure 7:
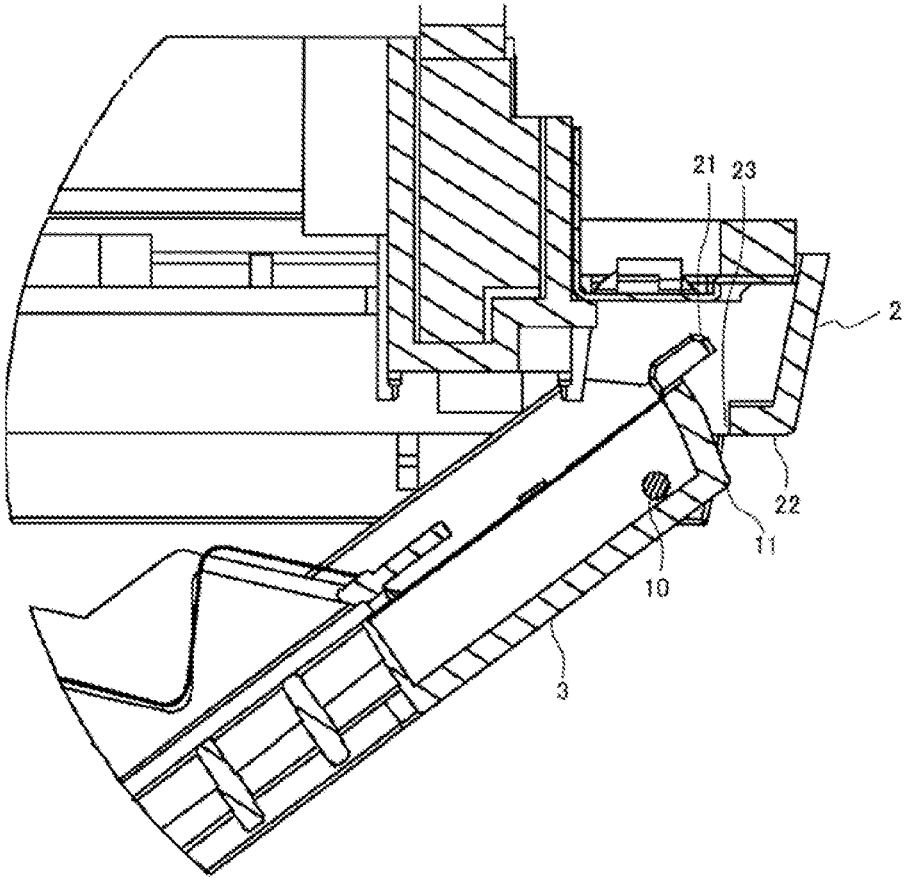
FIG. 7 illustrates the vertical cross-section illustrated in FIG. 6, with the inlet grille flap open halfway.
Figure 8:
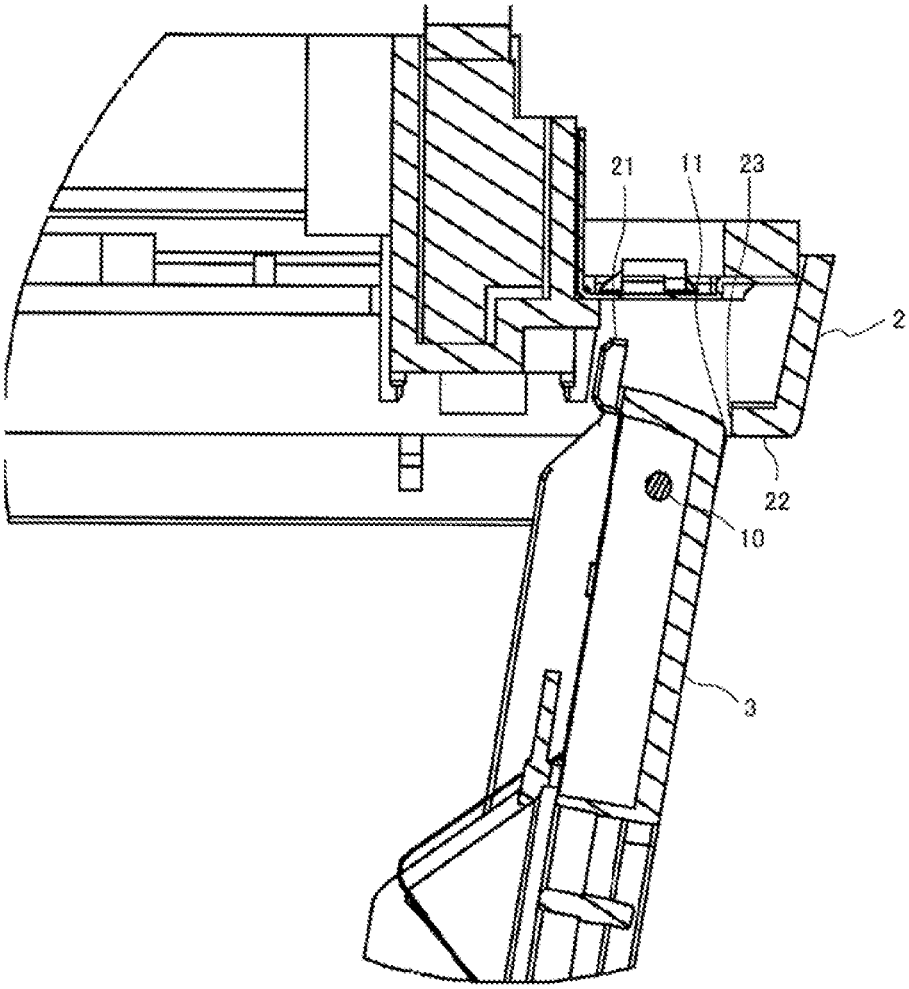
FIG. 8 illustrates the vertical cross-section illustrated in FIG. 6, with the inlet grille flap open.

FIG. 6 illustrates a vertical cross-section of the indoor unit 100 for a ceiling-concealed air-conditioning apparatus illustrated in FIG. 1, taken along plane B and seen in a direction represented by arrow C. FIG. 7 illustrates the vertical cross-section taken in the same way as FIG. 6, with the inlet grille flap 3 open halfway. FIG. 8 illustrates the vertical cross-section taken in the same way as FIG. 6, with the inlet grille flap 3 open. In FIGS. 6 to 8, one of the rotational-axis hinges 10, which are actually concealed, is illustrated for convenience of explanation.

As illustrated in FIG. 6, when the inlet grille flap 3 is closed, the flange 22 of the decorative panel 2 is positioned below the latch part 21 of the inlet grille flap 3, and the flange 22 supports the latch part 21 from below. In a side view of the indoor unit 100, the position where the flange 22 supports the latch part 21 from below when the inlet grille flap 3 is closed is shifted from the rotational-axis hinges 10 in the horizontal direction and in the vertical direction.

Specifically, the rotational-axis hinges 10 are positioned on the indoor side, corresponding to the lower side, relative to the latch part 21, and a distance L1 from the axis of the rotational-axis hinges 10 to a flange-side end 23 of the decorative panel 2 is larger than a distance L2 from the axis of the rotational-axis hinges 10 to a rear corner 11 of the inlet grille flap 3.

As illustrated in FIGS. 7 and 8, as the inlet grille flap 3 gets opened, the inlet grille flap 3 is tilted from a horizontally oriented position toward a vertically oriented position. In this process, the latch part 21 does not interfere with peripheral components. That is, the latch part 21 is provided at such a position as not to interfere with peripheral components in the process of the opening of the inlet grille flap 3.

As described above, in side view of the indoor unit 100, the position where the flange 22 supports the latch part 21 from below when the inlet grille flap 3 is closed is shifted from the rotational-axis hinges 10 in the horizontal direction and in the vertical direction. Furthermore, the latch part 21 is provided at such a position as not to interfere with peripheral components in the process of the opening of the inlet grille flap 3. Therefore, the inlet grille flap 3 is easy to close with no interference between the latch part 21 and peripheral components in the process of the closing of the inlet grille flap 3.

Furthermore, the distance L1 from the axis of the rotational-axis hinges 10 to the flange-side end 23 of the decorative panel 2 is larger than the distance L2 from the axis of the rotational-axis hinges 10 to the rear corner 11 of the inlet grille flap 3. Therefore, a gap between the decorative panel 2 and the inlet grille flap 3 with the inlet grille flap 3 closed can be made small.

Furthermore, the inlet grille flap 3 is configured in such a manner as not to go into the indoor-unit body 1 in the process of the opening of and closing the inlet grille flap 3. Therefore, no extra space for allowing the inlet grille flap 3 to go into the indoor-unit body 1 needs to be provided, and the size of the indoor-unit body 1 can be reduced.

A method of attaching the inlet grille flap 3 to the decorative panel 2 will be described.

First, the rotational-axis hinges 10 of the inlet grille flap 3 are fitted into their associated bearings of the decorative panel 2, whereby the rear end 3*b* is attached thereto. Then, the inlet grille flap 3 is rotated at the rotational-axis hinges 10 in such a manner as to face the decorative panel 2, and the front end thereof is secured to the decorative panel 2 with the securing structure. In this process, the latch part 21 of the inlet grille flap 3 is automatically supported from below by the flange 22 of the decorative panel 2, regardless of the intension of the worker. A method of detaching the inlet grille flap 3 from the decorative panel 2 follows the above attaching method inversely and is therefore not described herein.

To summarize, the indoor unit 100 for a ceiling-concealed air-conditioning apparatus according to Embodiment 1 includes the indoor-unit body 1 having the air inlet 1*a* at the bottom, the decorative panel 2 provided at the bottom of the indoor-unit body 1 and serving as a design surface, and the inlet grille flap 3 rotatably supported by the decorative panel 2 and covering the air inlet 1*a*. The inlet grille flap 3 is provided with the rotational-axis hinges 10 on the left and right sides, at the rear end 3*b*. The rotational-axis hinges 10 serve as the rotational axis of the inlet grille flap 3. The inlet grille flap 3 has the latch parts 21 positioned between the left and right rotational-axis hinges 10 and projecting from the rear end 3*b*. The decorative panel 2 has the flange 22 positioned below the latch part 21 and supporting the latch part 21 from below when the inlet grille flap 3 is closed.

In the indoor unit 100 for a ceiling-concealed air-conditioning apparatus according to Embodiment 1, since the flange 22 supports the latch part 21 from below, deformation of the inlet grille flap 3 due to the weight of the inlet grille flap 3 itself can be suppressed. Furthermore, since the flange 22 supports the latch part 21 from below when the inlet grille flap 3 is closed, the inlet grille flap 3 can be attached to the decorative panel 2 only by positioning the rotational-axis hinges 10. Thus, the ease of attaching the inlet grille flap 3 to the decorative panel 2 can be increased.

Furthermore, the latch part 21 is provided at such a position as not to interfere with peripheral components in the process of the opening of the inlet grille flap 3. Therefore, the inlet grille flap 3 is easy to close with no interference between the latch part 21 and peripheral components in the process of the closing of the inlet grille flap 3.

Furthermore, the inlet grille flap 3 projects to the indoor side relative to the decorative panel 2 when the inlet grille flap 3 is closed. Therefore, an improved design can be provided.

Furthermore, in the side view of the indoor unit 100, the position where the flange 22 supports the latch part 21 from below when the inlet grille flap 3 is closed is shifted in the vertical direction and in the horizontal direction from the position where the rotational-axis hinges 10 reside when the inlet grille flap 3 is open. Therefore, the inlet grille flap 3 is easy to close with no interference between the latch part 21 and peripheral components in the process of the closing of the inlet grille flap 3.

Furthermore, when the inlet grille flap 3 is closed, the distance L1 from the axis of the rotational-axis hinges 10 to the flange-side end 23 of the decorative panel 2 is larger than the distance L2 from the axis of the rotational-axis hinges 10 to the rear corner 11 of the inlet grille flap 3. Therefore, the gap between the decorative panel 2 and the inlet grille flap 3 with the inlet grille flap 3 closed can be made small.

Furthermore, the latch part 21 has a trapezoidal shape in front view. Therefore, the interference between the latch part 21 and peripheral components that may occur in the process of attaching the inlet grille flap 3 to the decorative panel 2 is suppressed. Accordingly, the ease of attaching the inlet grille flap 3 to the decorative panel 2 can be increased.

Embodiment 2

Embodiment 2 of the present invention will now be described. Description already given in Embodiment 1 is omitted, and elements that are the same as or corresponding to those described in Embodiment 1 are denoted by corresponding ones of the reference numerals.

Figure 9:
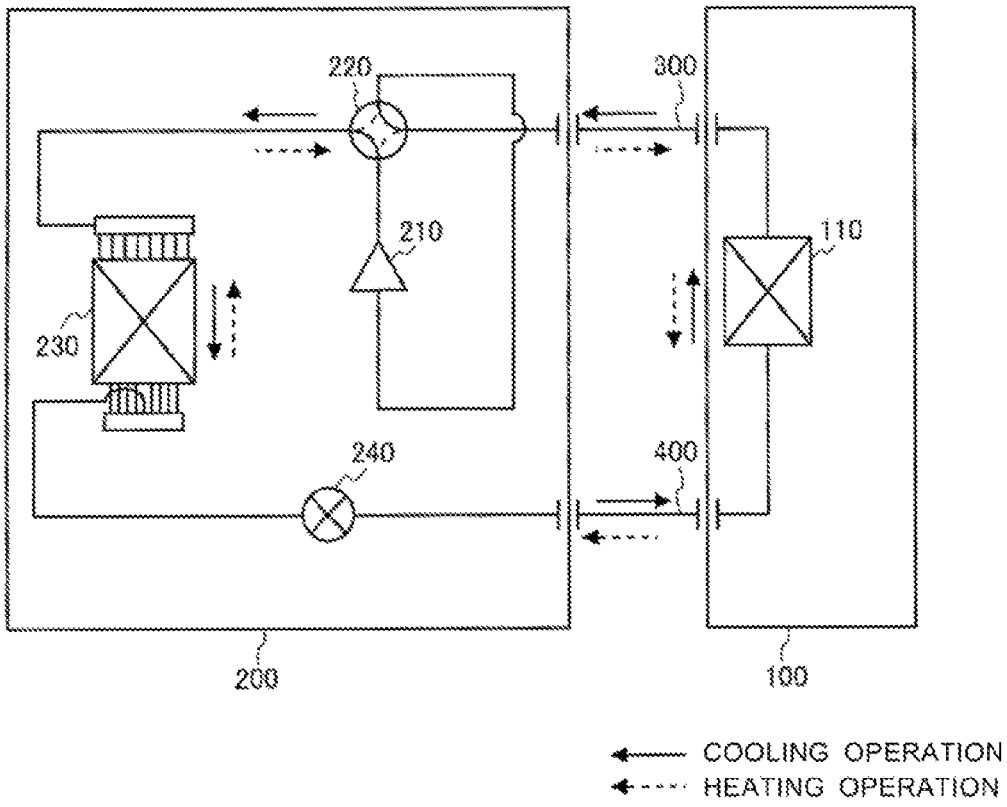
FIG. 9 is a diagram illustrating an exemplary configuration of a ceiling-concealed air-conditioning apparatus according to Embodiment 2 of the present invention.

FIG. 9 is a diagram illustrating an exemplary configuration of a ceiling-concealed air-conditioning apparatus according to Embodiment 2 of the present invention. In FIG. 9, solid lines represent the flow of refrigerant in a cooling operation, and broken lines represent the flow of refrigerant in a heating operation.

The ceiling-concealed air-conditioning apparatus according to Embodiment 2 includes the indoor unit 100 described in Embodiment 1, and an outdoor unit 200. The indoor unit 100 and the outdoor unit 200 are connected to each other by refrigerant pipes, which are a gas-refrigerant pipe 300 and a liquid-refrigerant pipe 400.

The indoor unit 100 includes an indoor heat exchanger 110. The outdoor unit 200 includes a compressor 210, a four-way valve 220, an outdoor heat exchanger 230, and an expansion device 240.

In the ceiling-concealed air-conditioning apparatus according to Embodiment 2, the compressor 210, the four-way valve 220, the outdoor heat exchanger 230, the expansion device 240, and the indoor heat exchanger 110 are connected in series by the refrigerant pipes, whereby a refrigeration cycle device through which the refrigerant circulates is provided.

The compressor 210 takes in the refrigerant and compresses the refrigerant before discharging the refrigerant. The compressor 210 may be configured such that, for example, the capacity (the amount of refrigerant to be discharged per unit time) is changeable by arbitrarily changing the operating frequency with an inverter circuit or any other device.

The four-way valve 220 is a refrigerant-flow-switching device that switches the flow of the refrigerant between, for example, that for the cooling operation and that for the heating operation. While Embodiment 2 concerns a case where the four-way valve 220 is employed as the refrigerant-flow-switching device, the four-way valve 220 may be replaced with, for example, a combination of a two-way valve and a three-way valve.

The outdoor heat exchanger 230 allows the refrigerant and outdoor air to exchange heat therebetween. For example, in the heating operation, the outdoor heat exchanger 230 functions as an evaporator to evaporate and thus gasify the refrigerant. In the cooling operation, the outdoor heat exchanger 230 functions as a condenser to condense and thus liquefy the refrigerant.

The expansion device 240 decompresses and thus expands the refrigerant. The expansion device 240 also regulates the flow rate of the refrigerant. For example, if an electronic expansion valve is employed as the expansion device 240, the opening degree of the expansion device 240 is adjusted in accordance with an instruction made by a control device (not illustrated) or any other like device.

The indoor heat exchanger 110 allows the refrigerant and indoor air, which is the object of air-conditioning, to exchange heat therebetween. For example, in the heating operation, the indoor heat exchanger 110 functions as a condenser to condense and thus liquefy the refrigerant. In the cooling operation, the indoor heat exchanger 110 functions as an evaporator to evaporate and thus gasify the refrigerant.

To summarize, the ceiling-concealed air-conditioning apparatus according to Embodiment 2 includes the indoor unit 100, and the outdoor unit 200 that includes the four-way valve 220. Therefore, the heating operation and the cooling operation can be realized by switching the flow of the refrigerant with the four-way valve 220 of the outdoor unit 200.

REFERENCE SIGNS LIST

1 indoor-unit body 1*a* air inlet 1*b* air outlet 2 decorative panel 2*a* rear side face 3 inlet grille flap 3*a* rear side face 3*b* rear end 4 step 10 rotational-axis hinge 11 rear corner 20 securing hinge 21 latch part 21*a* end 22 flange 23 flange-side end 100 indoor unit 110 indoor heat exchanger 200 outdoor unit 210 compressor 220 four-way valve 230 outdoor heat exchanger 240 expansion device 300 gas-refrigerant pipe 400 liquid-refrigerant pipe

The invention claimed is:

1. An indoor unit for a ceiling-concealed air-conditioning apparatus which includes at least a compressor, an indoor heat exchanger, and an outdoor heat exchanger, all connected by piping, the indoor unit comprising:

an indoor-unit body having an air inlet at a bottom;

a decorative panel provided at the bottom of the indoor-unit body and serving as a design surface; and an inlet grille flap rotatably supported by the decorative panel and covering the air inlet, the inlet grille flap being provided with a rotational-axis hinge positioned on each of both sides at one edge of the inlet grille flap and serving as a rotational axis of the inlet grille flap, and a latch part positioned between the two rotational-axis hinges and projecting from the one edge, the decorative panel having a flange positioned below the latch part and supporting the latch part from below when the inlet grille flap is closed, wherein, in a side view, the position where the flange supports the latch part from below when the inlet grille flap is closed is shifted in a vertical direction and in a horizontal direction from a position where the rotational-axis hinges reside when the inlet grille flap is open, and wherein, in a front view, the position where the flange supports the latch part from below when the inlet grille flap is closed is between the plurality of rotational-axis hinges.

2. The indoor unit for a ceiling-concealed air-conditioning apparatus of claim 1, wherein the latch part is provided at such a position as not to interfere with peripheral components in a process of opening the inlet grille flap.

3. The indoor unit for a ceiling-concealed air-conditioning apparatus of claim 1, wherein the inlet grill flap projects to an indoor side relative to the decorative panel when the inlet grille flap is closed.

4. The indoor unit for a ceiling-concealed air-conditioning apparatus of claim 1, wherein when the inlet grille flap is closed, a distance from an axis of the rotational-axis hinges to a flange-side end of the decorative panel is larger than a distance from the axis of the rotational-axis hinges to a corner of the inlet grille flap at the one edge.

5. The indoor unit for a ceiling-concealed air-conditioning apparatus of claim 1, wherein the latch part has a trapezoidal shape in the front view.

6. A ceiling-concealed air-conditioning apparatus comprising:

the indoor unit for a ceiling-concealed air-conditioning apparatus of claim 1; and an outdoor unit for a ceiling-concealed air-conditioning apparatus that includes a flow-switching valve.

7. The indoor unit for a ceiling-concealed air-conditioning apparatus of claim 1, wherein, in a side view, a full range of the position where the flange supports the latch part from below when the inlet grille flap is closed is shifted in a vertical direction and in a horizontal direction from a position where the rotational-axis hinges reside when the inlet grille flap is open, and between the plurality of rotational-axis hinges.

* * * * *